United States Patent [19]

Lindsey

[11] Patent Number: 4,712,290

[45] Date of Patent: Dec. 15, 1987

[54] TEXTILE AND METHOD OF MANUFACTURE

[75] Inventor: James N. Lindsey, Sylacauga, Ala.

[73] Assignee: Avondale Mills, Sylacauga, Ala.

[21] Appl. No.: 890,939

[22] Filed: Jul. 28, 1986

[51] Int. Cl.[4] ..... D06L 1/14; D06M 16/00

[52] U.S. Cl. ..... 28/178; 8/138; 106/212; 252/174.12; 252/DIG. 12; 427/175; 427/394; 427/397.7; 427/416; 428/378; 428/246; 428/248; 428/264; 435/263

[58] Field of Search ..... 8/138; 28/178; 427/175, 427/416, 394, 397.7; 435/263

[56] References Cited

U.S. PATENT DOCUMENTS

| | | | |
|---|---|---|---|
| 2,361,830 | 10/1944 | Edelstein | 427/416 |
| 3,427,192 | 2/1969 | Bolinger | 427/416 |
| 3,627,688 | 12/1971 | McCarty | 435/263 |
| 3,634,266 | 1/1972 | Theile et al. | 435/263 |
| 3,741,902 | 6/1973 | Barrett et al. | 435/263 |
| 3,983,272 | 9/1976 | Huber et al. | 427/416 |
| 4,391,745 | 7/1983 | Denkler et al. | 8/138 |
| 4,443,355 | 4/1984 | Murata et al. | 435/263 |
| 4,532,154 | 7/1985 | Harteman | 427/416 |

*Primary Examiner*—James C. Cannon
*Attorney, Agent, or Firm*—Darby & Darby

[57] ABSTRACT

Yarn to be utilized for the manufacture of pre-softened fabric is stiffened without the use of binding agents. Only corn starch and low temperature wax are utilized as stiffeners. Fabric manufactured from such yarn is then subjected to a finishing process, in which enzymes capable of breaking down the corn starch and a wetter/rewetter are added to the fabric itself. These enzymes are activated during a subsequent soaking in water only, followed by agitation, whereby stiffness may be removed from the fabric in approximately 5 minutes. In accordance with another aspect of the invention, softeners are also added to the fabric during the finishing process. The softeners are also released during the subsequent garment washing operation. Preferably, the softeners include at least reactive silicon. This serves the additional purpose of lubricating sewing needles and cutting knives during the garment manufacturing process.

15 Claims, 2 Drawing Figures

TEXTILE AND METHOD OF MANUFACTURE

The present invention relates generally to textiles and their manufacture and, more particularly, concerns a textile, and the process for manufacturing the same, which is readily converted to a finished and softened form with minimum washing in water only. The present invention finds particular application with respect to the manufacture of "pre-washed" denim garments.

BACKGROUND OF THE INVENTION

Garments are typically manufactured from textiles which are made from a yarn that has been stiffened with various agents, such as corn starch and mixtures of corn starch with binders. Such treatment of the yarn makes it easier to handle and, in particular, to weave the yarn into a fabric. In addition, the resulting fabric has substantial body and stiffness, which simplifies cutting of the fabric and sewing it into garments. The stiffened yarn is therefore preferred for the manufacture of textiles, as well as for the manufacture of garments from the textiles.

However, garments manufactured from the stiffened textile tend to be quite rigid and uncomfortable to the wearer, and they also tend to be unnaturally hard to the touch. With certain types of textiles, for example, denim, the stiffness and coarseness to the touch are particularly pronounced. For this reason, "pre-washed" denim garments have become increasingly popular in recent years, and consumers have been willing to pay a premium price for denim garments, in which the stiffness has been removed and the softness to the touch or "hand" has been improved.

Moreover, the manufacture of a pre-softened fabric, particularly denim, has, until now, involved considerable time and expense on the part of garment manufacturers. For presoftening, the completed garment is washed, under continuous agitation, in an enzyme solution which removes the stiffening agents. Thereafter, a softening agent is added to the fabric rinse, in order to improve its hand. This entire cycle takes approximately 30 minutes. It is therefore necessary to turn the garment inside out, in order to avoid damaging the finished side of the garmet during this rather long period of time that the garment is constantly agitated. Thereafter, the garment is turned right-side out, is dried, and is pressed.

Not only does pre-washing of garments required capital expenditures in manufacturng equipment, but it is necessary to retain the necessary chemicals within the laundry room of the garment factory. In addition, a substantial amount of water is utilized in pre-washing, and substantial amounts of energy are utilized in pre-washing and in drying. Since it requires in excess of 30 minutes to pre-wash and dry garments, and this is a substantially long period of time in the production cycle, the throughput rate of finished garments is substantially adversely affected. Also, additional labor costs are involved in turning the garments inside out for washing and then right-side out after washing is completed. All of these factors add substantially to the cost of the garment, making pre-washed denim products unduly expensive.

Broadly, it is an object of the present invention to provide a textile and a method of manufacturing the same which substantially avoids the disadvantageous associated with manufacturing prior art pre-softened garments.

It is specifically an object ot the present invention to provide a stiffened fabric and a process for manufacturing the same, which fabric may be softened by washing for a relatively short period of time in water only, without the addition of chemicals.

It is a further object of the present invention to provide a stiffened fabric and a process for manufacturing the same, which fabric may be softened, without the use of softening chemicals after a garment has been manufactured from the fabric.

It is also an object of the present invention to provide a pre-softened garment which is relatively inexpensive compared to prior art garments of this type, yet exhibits equivalent softness qualities.

It is yet another object of the present invention to provide a process for manufacturing a pre-softened fabric which is relatively inexpensive and reliable in use, yet results in a fabric exhibiting relatively high qualities of softness.

In accordance with the present invention, yarn to be utilized for the manufacture of pre-softened fabric is stiffened without the use of binding agents. Only corn starch and low temperature wax are utilized as stiffeners. Fabric manufactured from such yarn is then subject to a finishing process, in which enzymes capable of breaking down the corn starch and a wetter/rewetter are added to the fabric itself. These enzymes are activated during a subsequent soaking in water only, followed by agitation, whereby stiffness may be removed from the fabric in approximately 5 minutes.

In accordance with another aspect of the invention, softeners are also added to the fabric during the finishing process. The softeners are also released during the subsequent garment washing operation. Preferably, the softeners include at least reactive silicon. This serves the additional purpose of lubricating sewing needles and cutting knives during the garment manufacturing process.

It is a feature of the present invention that stiffening agents can be removed from a finished garment by soaking and agitation of the garment in water only for a period of approximately 5 minutes.

It is another feature of the present invention that, not only does the reactive silicon add permanent softness to a garment manufactured from the fabric of the invention, but the lubrication it provides and the shortened agitation time reduce abrasiveness of the fabric, so that a garment does not have to be turned inside-out for the washing operation.

It is yet another feature of the fabric of the present invention that garments manufactured therefrom may be sold to the consumer in the rigid, unwashed state and will become soft and desirable with a single home washing by the comsumer.

BRIEF DESCRIPTION OF THE DRAWING

The foregoing brief description, as well as further objects, features, and advantageous of the present invention will be understood more completely from the following detailed description of a presently preferred, but nonetheless illustrative, embodiments thereof, with reference being had to the drawing in which.

DETAILED DESCRIPTION

Figure 1:
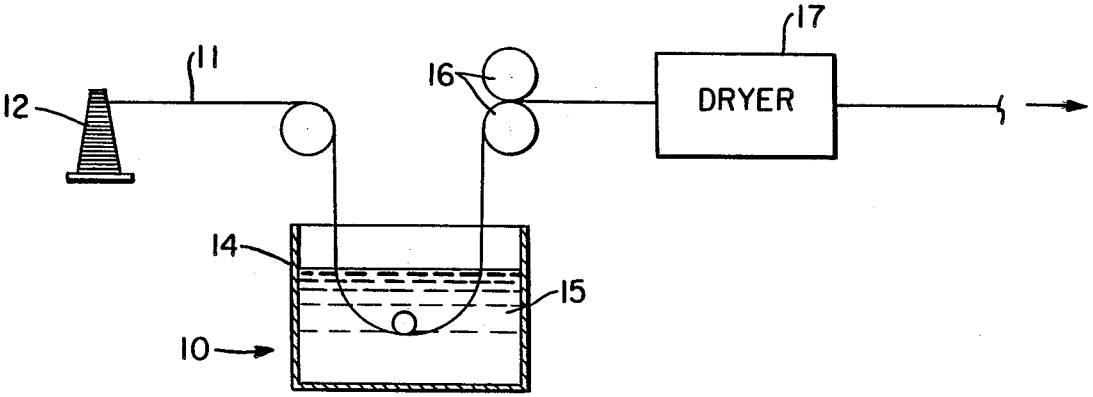
FIG. 1 is a schematic diagram illustrating the manufacture of a stiffened yarn in accordance with the invention.
Figure 2:
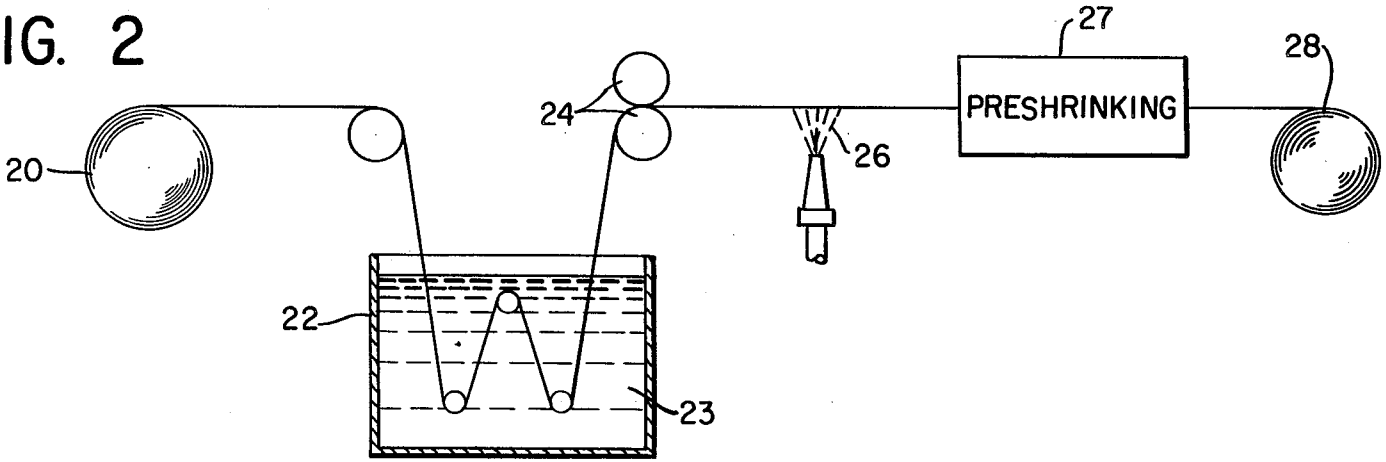
FIG. 2 is a schematic diagram illustrating the manufacture of a fabric in accordance with the present invention so as to permit ready pre-softening of a garment manufactured from the fabric.

FIGS. 1 and 2 are useful in describing the manufacture of a pre-softened denim garment in accordance with the present invention. Initially, the yarn from which the garment is to be manufactured receives an application of a "size" material. In known processes, this material is a solution of corn starch and various size binders. Typically, this application has been done on a machine called a "slasher". As shown in FIG. 1, in the slasher 10, the untreated yarn 11 is received on beams 12 and is transported to a tank 14 which contains the size solution 16. As a result, the yarn absorbs the solution. At the outlet of the tank, the yarn is compressed between rollers 16, the pressure of which is calculated to retain a predetermined amount of the solution within the yarn. Thereafter, the yarn is dried and placed upon take-up beams. Yarn which has been treated in this manner has a substantial body and stiffness, which makes it ideal for weaving into a fabric. In addition, the resulting fabric has substantial body and stiffness, which makes it easy to cut the fabric and sew it into the form of garments. However the fabric is also very coarse to the touch, which is undesirable.

In accordance with the present invention, the size material is free of binders and includes only corn starch and low temperature wax (i.e. wax having a melting temperature below 150° F.). The size solution is preferably a water bath which is maintained at 190°F., containing approximately 9% by weight corn starch and 0.9 by weight wax. The yarn is transported through this emulsion at a rate of approximately 60 yarns per minute, and the rollers 18 at the output of the slasher are adjusted to a pressure that results in the yarn retaining 110% by weight of the solution. That is, 110 pounds of solution are retained in every 100 pounds of yarn fed into the slasher. Thus, after the yarn is dried, it will contain approximately 10% by weight corn starch and 1% by weight wax. It has been found, however, that a yarn having as little as 4% by weight corn starch and 0.4% by weight wax will be acceptable for use in fabric manufacture.

Although a specific process for treating the yarn has been described, those skilled in the art will appreciate that the yarn can be effectively treated by any process which will deposit approximately 10% by weight of corn starch and approximately 1% by weight of wax within the fibre yarns, in the absence of binders.

In accordance with the present invention, after the yarn has been woven into a fabric, the fabric is subjected to a finishing process, as illustrated in FIG. 2. In accordance with the preferred embodiment, this process can be performed on a conventional "tenter frame" or a "can finish range". On either of these devices, the fabric is retained on a roll 20 and the fabric web 21 is transported through a solution-containing tank 22 in serpentine fashion, whereby the fabric web absorbs a portion of the solution 23 from the finishing bath. Preferably, the finishing bath is a solution, in water, of 2.9% by weight amylase enzymes, 0.88% by weight of reactive silicone, 1.5% by weight of a cationic softener, 2.35% by weight of a non-ionic wetter/rewetter and 0.88% by weight of a non-ionic pre-shrinking lubricant. The solution is formed and maintained at 100° F., while being agitated. The wetter/rewetter is added to the water first and is allowed to dissolve. The remaining ingredients, with the exception of the enzymes, may then be added in any order and permitted to dissolve under agitation, after which the enzymes may be added.

Although the components of the finishing bath may be any commercially available products meeting the generic description, certain products are presently preferred. The amylase enzymes are preferably a product sold under the trademark Rapidaase X-C by G.B. Fermentations Industries, Inc. of Charlotte, N.C. The reactive silicone is preferably Vircotex SIL, which is commercially available from Virkaler Chemical Company of Charlotte, N.C. However, any commercially available silicone which chemically bonds to the cellulose of the fabric by a cationic reaction would work equally well. The cationic softener is preferably Vircosoft SLP-9, which is commercially availabe from Virkler Chemical Company. The non-ionic wetter/rewetter is preferably K-wet 9110-M, which is commercially available from KPL Industries of Sylacauga, Ala. The non-ionic pre-shrinking lubricant is preferably Discosoft-583-A, which is commercially available from Callaway Chemical Company of Columbus, Ga.

The fabric to be finished is preferably transported through the finishing solution at a rat of 50–70 yards per minute. However, this is not a critical parameter and the fabric may be transported at a substantially slower or faster rate, the essential limitation being the rate at which the fabric can be dried downstream. At the outlet of the solution tank 22, the fabric is compressed between a pair of rollers 24, the compression pressure of which is calculated to leave 100% by weight of the finishing solution on the fabric. That is, 1 pound of finishing solution is left on the fabric for each pound of fabric being subject to the finishing process. Thereafter, the fabric is subjected to a drying process. Preferably, this is accomplished by transporting the fabric through a stream 26 of hot air at 300° F. In a conventional tenter frame, effective drying is achieved by transporting the fabric at a rate of about 50 yard per minute whereas effective drying can be achieved in a conventional can finish range by transporting the fabric at a speed of about 70 yards per minute. Assuming a more effective apparatus could be obtained for drying the fabric, the transportation rate can be increased, which would result in a faster throughput rate of finished product. Before being received on a take-up roll 28, the fabric is subjected to a conventional preshrinking process (represented by block 27 in FIG. 2), for shrinkage control The finished fabric may then be transported to another location for manufacture into garment products.

Although the corn starch within fabric subject to the above-described finishing process does experience some degradation before the fabric is dried, the fabric still has the necessary stiffness needed for cutting and sewing during the manufacture of garments. This stiffness can, however, be removed from the finished garment with 2–3 minutes of soaking followed by 2–3 minutes of agitation in a simple water bath, without the additon of chemicals. This is possible because of the absence of binders from the original size solution and because the enzymes applied to the fabric during the finishing process are activated during this final rinse, whereby the corn starch is degraded. The reactive silicone and cationic softener, which are also added during the fabric finishing process, are not utilized in reducing the stiffness of the fabric, but to improve the way that the fabric feels to the touch or its "hand". The reactive silicone is a permanent softener, which is relatively expensive.

The cationic softener is a short-term softener, which is used as a filler for the reactive silicone. The relatively short rinse cycle required to reduce the stiffness of the fabric during laundering makes is possible to use a substantial proportion of the relatively inexpensive cationic softener, without the danger of it being washed away. Since the softeners are present in the finished garment, it is unnecessary to add such softeners during laundering of the garment, as is usually the case. The decrease laundering time which is possible with a fabric in accordance with the present invention results in reduced water and energy usage. In addition, the substantial abrasion of the garment which occurs during constant agitation in the laundering process is eliminated and it is no longer necessary to reverse garments for laundering. This results in a substantial saving in labor cost.

Although a specific fabric finishing process has been described above for illustrative purposes, those skilled in the art will appreciate that essentially the same finished fabric could be obtained by any finishing process which leaves the same percentages by weight of the finishing bath components on the finished fabric. That is, the same fabric described above would be obtained by any process which leaves 2.9% by weight of amylase enzymes, 0.88% by weight of reactive silicone, 1.5% by weight of cationic softener, 2.35% by weight of non-ionic wetter/rewetter and 0.88% by weight of non-ionic pre-shrinking lubricant. In addition, although the proportions of the finishing bath components described above are preferred, it has been found that effective reduction in the stiffness of the fabric can be achieved with the addition of as little as 0.5% by weight of amylase enzymes and the use of 0.25% by weight of a non-ionic wetter/rewetter. Also, the desired hand of the fabric can be obtained by using as little as 0.025% reactive silicone and 0.5% of cationic softener. Effective reduction of friction and abrasion experienced during pre-shrinking can be reduced by using as little as 0.25% by weight non-ionic pre-shrinking lubricant.

The above description explains how the present invention would permit the manufacture of "pre-softened" garments. However, it is contemplated that the invention could also be used to manufacture garments sold in their rigid (i.e. stiff and unsoftened) form, which garments would be converted to a soft, finished state after only a single home washing by the consumer. Since the final laundering operation could be eliminated entirely with respect to such garments during manufacture, they could be sold at a substantial cost saving to the consumer.

Although preferred forms of the invention have been disclosed for illustrative purposes, those skilled in the art will appreciate that many additions, modifications and substitutions are possible, without departing from the scope and spirit of the invention as described in the accompanying claims.

What is claimed is:

1. A method for treating a stiffened fabric to permit ready softening of garments manufactured therefrom, the fabric having been stiffened by the addition of at least 4% by weight corn starch and at least 0.4% by weight of a wax having a melting temperature below 150° F., said method comprising the steps:

of introducing into said fabric at least 0.25% by weight of a non-ionic wetter/rewetter; and introducing into said fabric at least 0.5% by weight of at least one enzyme capable of decomposing corn starch while leaving said fabric essentially unaffected.

2. The method of claim 1, wherein said enzyme is an amylase.

3. The method of claim 1, wherein the percentage of said wetter/rewetter is approximately 2.35% and the percentage of said enzyme is approximately 2.9%.

4. The method of claim 3, further comprising the steps of adding to said product at least 0.025% reactive silicone and at least 0.5% of cationic softener.

5. The method of claim 4, wherein the percentage of reactive silicone is approximately 1.5% and the percentage of cationic softener is approximately 2.35%.

6. The method of claim 1, further comprising the steps of adding to said fabric at least 0.025% by weight reactive silicone and at least 0.5% by weight of cationic softener.

7. The method of claim 6, wherein the percentage of reactive silicone is approximately 1.5% and the percentage of cationic softener is approximately 2.35%.

8. In a method for manufacturing a readily softened garment from a fabric manufactured from yarn which has been stiffened by the addition of corn starch and a wax having a melting temperature below 150° F., in the absence of any chemical binding agents, said method comprising the steps of:

forming a solution in water of at least 0.25% by weight of a non-ionic wetter/rewetter;

dissolving in said solution at least 0.5% by weight of an enzyme capable of decomposing said corn starch and having essentially no effect on said yarn;

introducing said fabric into said solution in the form of a web;

subjecting said web to compression such that said web retains 100% by weight of said solution; and subjecting said web to rapid drying.

9. The method of claim 8, wherein said enzyme is an amylase.

10. The method of claim 9 wherein, prior to introducing said enzyme to said solution, at least 0.025% by weight of reactive silicone and at least 0.5% by weight of a cationic softener are dissolved in said solution.

11. The method of claim 10 wherein the percentage of reactive silicone is approximately 0.88% and the percentage of cationic softener is approximately 1.5 percent.

12. A method for stiffening fibre yarn so as to permit ready softening of fabric manufactured therefrom, said method comprising the steps of introducing into said yarn a sufficient quantity of corn starch to produce the desired stiffening and introducing into said yarn a quantity of wax having a melting temperature below 150° F., said quantity being approximately 10% by weight of the corn starch, said corn starch and wax being introduced in the absence of chemical binding agents.

13. The method of claim 12 wherein said corn starch is at least 4% by weight of said yarn.

14. The method of claim 13 wherein said corn starch is approximately 10% by weight of said yarn.

15. A fabric manufactured by the method of any one of claims 1–11.

* * * * *